United States Patent [19]

Kohus et al.

[11] Patent Number: 4,688,280

[45] Date of Patent: Aug. 25, 1987

[54] FOLDABLE PLAYPEN ASSEMBLY WITH EASE OF PORTABILITY

[75] Inventors: Louis M. Kohus; John V. Mariol, both of Cincinnati, Ohio

[73] Assignee: KohusMariol, Inc., Cincinnati, Ohio

[21] Appl. No.: 921,140

[22] Filed: Oct. 20, 1986

[51] Int. Cl.[4] ..... A47C 29/00

[52] U.S. Cl. ..... 5/99 R; 5/99 A; 5/99 C

[58] Field of Search ..... 5/93 R, 98 R, 99 R, 5/99 A–99 C, 111

[56] References Cited

U.S. PATENT DOCUMENTS

| | | | |
|---|---|---|---|
| 2,498,203 | 2/1950 | Fischer | 5/99 A |
| 2,523,422 | 9/1950 | Dunn | 5/99 C |
| 2,574,079 | 11/1951 | White | 5/99 C |
| 3,605,139 | 9/1971 | Lorentz, Jr. | 5/99 R |
| 4,008,499 | 2/1977 | Wren, Jr. et al. | 5/99 C |

*Primary Examiner*—Gary L. Smith
*Assistant Examiner*—Michael F. Trettel
*Attorney, Agent, or Firm*—Charles R. Wilson

[57] ABSTRACT

A portable playpen assembly comprises a frame assembly and a fabric enclosure. The frame assembly comprises a horizontally hinged bifold hub wherein each hinge half is capable of receiving a first end of a floor support bar. A set of frame members are provided wherein each frame member comprises a floor support bar, an enclosure support bar, a corner support casing with means for attachment thereto of a second end of the floor support bar and means for attachment thereto of the enclosure support bar which permits the enclosure support bar to swing from an upright position to a horizontal position, and latch means for holding the enclosure support bar in an upright position. The frame assembly is foldable to a compact unit. When in use, the frame assembly is capable of holding a fabric enclosure so as to provide a playpen assembly.

12 Claims, 17 Drawing Figures

FOLDABLE PLAYPEN ASSEMBLY WITH EASE OF PORTABILITY

This invention relates to a playpen assembly. More particularly, the invention relates to a playpen assembly which is foldable into a compact unit and thereby very portable.

BACKGROUND OF THE INVENTION

Many different playpens have been designed and suggested for use. Most of the playpens which have been commercialized are rather bulky and very cumbersome to use. Even those playpens which are said to be portable are cumbersome to use. Various examples of such playpens can be found in U.S. Pat. Nos. 2,464,866; 2,491,036; 2,590,315; 2,784,420; 3,165,760; and 4,538,309.

While certain of the playpens are referred to as being foldable, they can only be folded to a size which is still generally large and difficult to transport. Other playpens which are said to be portable are in fact of the type which must be disassembled and later reassembled. It is readily apparent that the known playpens are not convenient to use either because of their bulky size or because of the time consuming steps needed for disassembly and reassembly.

There is a very apparent need for a playpen which is truly portable. Such a playpen necessarily must be foldable into a size which is compact. Ideally, the playpen would be comprised of a minimum number of parts so as to allow for an easy folding series of steps as well as to reduce the cost of any such structure. In accordance with this need, there is disclosed herein a portable playpen which is foldable to a compact state. The playpen is economical to manufacture and is easy to use.

SUMMARY OF THE INVENTION

In accordance with the present invention, a portable playpen assembly comprises a frame assembly and a fabric enclosure adapted to fit onto the frame assembly. The frame assembly is comprised of a horizontally hinged hub having means for attachment thereto of floor support bars. A set of at least four frame members are provided. Each is comprised of a corner support casing having attached thereto a floor support bar, an enclosure support bar which is swingable from a position essentially parallel with the floor to an upright position, and latch means to hold the enclosure support bar in the upright position. When fully assembled, the frame assembly is capable of having a fabric enclosure positioned thereon. The playpen assembly is folded into a compact size by moving the enclosure support bars to a position which is substantially parallel to the floor support bars and thereafter folding the horizontallly hinged hub together so as to cause the frame members to fold towards one another.

DETAILED DESCRIPTION OF THE INVENTION

The portable playpen of this invention comprises a frame assembly and a fabric enclosure. The following paragraphs describe in detail the frame assembly and the fabric enclosure forming a part of the invention.

Figure 1:
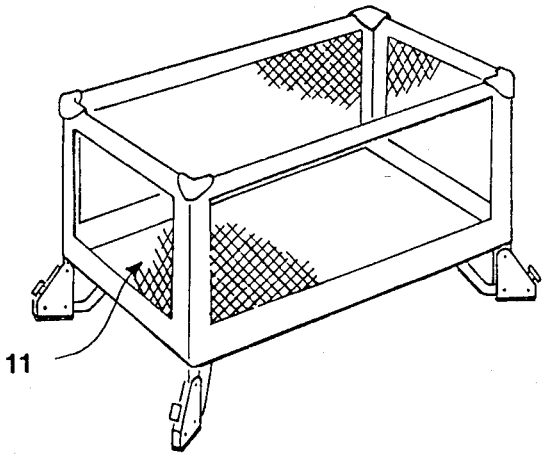
FIG. 1 is a view in perspective of a portable playpen when assembled in accordance with the present invention.
Figure 2:
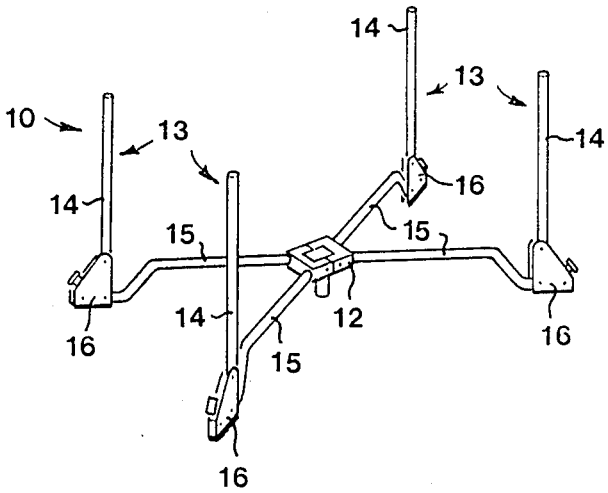
FIG. 2 is a view in perspective of the frame assembly of the playpen of FIG. 1.

With reference to FIG. 1 there is illustrated a playpen of the invention wherein a frame assembly is in its in-use position with a fabric enclosure 11 properly positioned on the assembly. The frame assembly 10 as best seen in FIG. 2 comprises a horizontally hinged bifold hub 12 and four frame members shown generally as 13. Each of the frame members radiates from the hinged hub in a substantially equally spaced arrangement for maximum support. While four members are shown, more can be utilized for added support and strength; generally, however, four frame members is sufficient and is preferred for economy and ease of assembly reasons. As shown, the four members radiate outwardly to the corners of a four-sided playpen.

Figure 3:
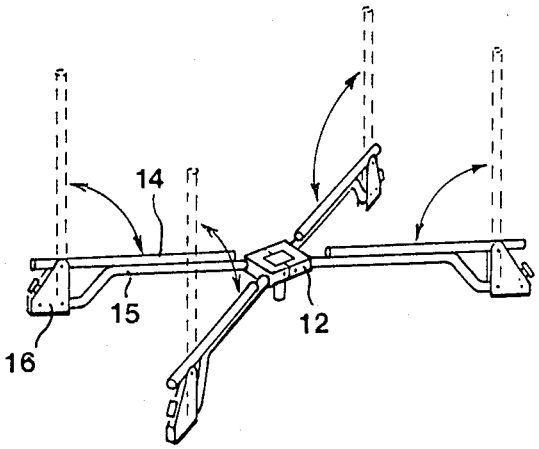
FIG. 3 is a view in perspective of the frame assembly of FIG. 2 with the enclosure support bars folded down to a position which is intermediate in the sequence of folding positions.
Figure 4:
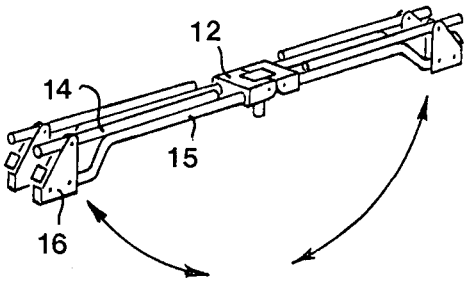
FIG. 4 is a view in perspective of the frame assembly of FIG. 2 with each set of the frame members swung towards one another and in a position next prior to a fully folded frame assembly.
Figure 5:
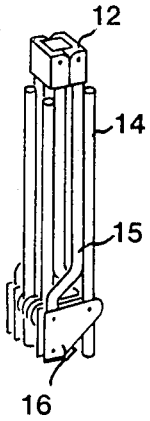
FIG. 5 is a view in perspective of the frame assembly of FIG. 2 when in a fully folded state.

FIGS. 2-5 show the frame assembly in a series of positions ranging from the fully opened position of FIG. 2 to the fully folded position of FIG. 5. The first step of folding the frame assembly is shown in FIG. 3 wherein each of the enclosure support bars 14 is folded downwardly so as to be substantially parallel with a floor support bar 15 emanating from a common corner support casing 16. The second step of the folding process is shown in FIG. 4. Each of the frame members is moved about its point of attachment to the hinged hub 12 from a position radiating towards a corner to a position juxtapositioned a second frame member emanating from the same hinge half. The fully folded position of the frame assembly as shown in FIG. 5 is achieved by lifting the assembly at the hinged hub 12 and allowing the hinged halves to close towards one another. This causes corner support casings 16 of opposite frame members to swing towards one another. In effect, the four corner support casings now provide a base for the fully folded frame assembly thereby allowing it to sit in an upright convenient position shown in FIG. 5.

Figure 6:
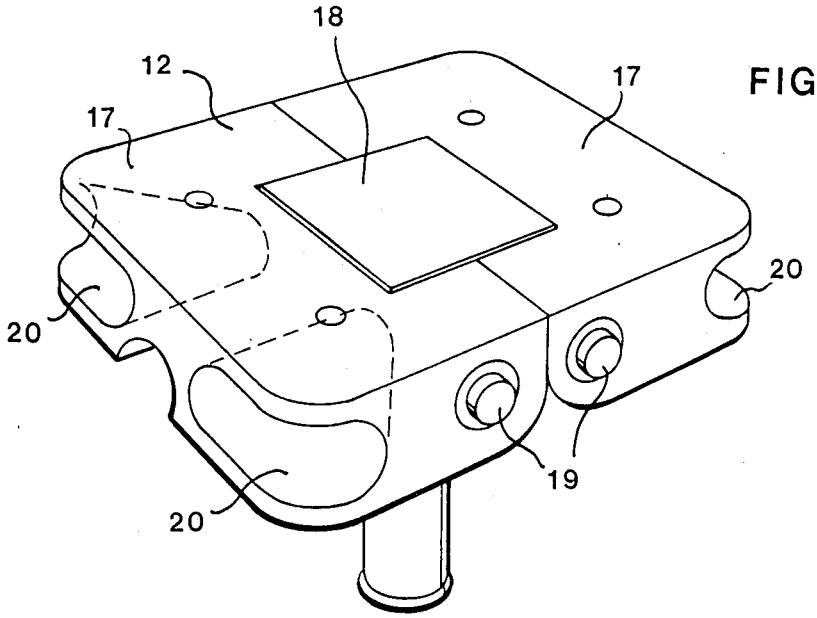
FIG. 6 is a view in perspective of the hinged hub of the frame assembly of FIG. 2 in an open position.
Figure 7:
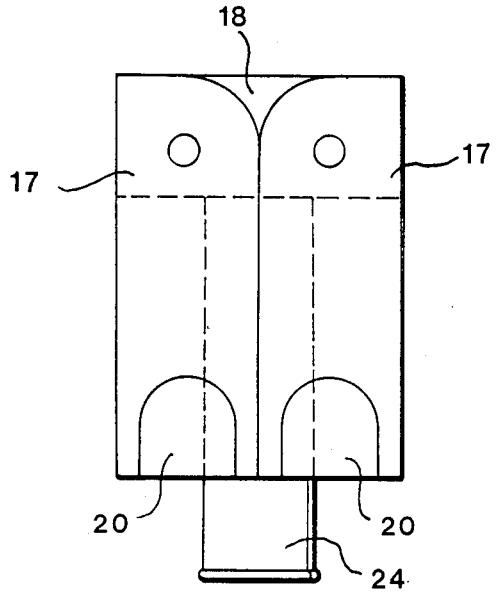
FIG. 7 is a front view of the hinged hub of FIG. 6 in a closed position with a center support leg.
Figure 8:
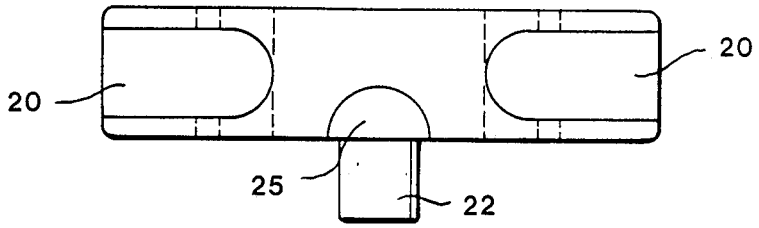
FIG. 8 is an end view of the hinged hub of FIG. 6 without the center support leg.

The horizontally hinged hub 12 as evident from FIG. 6 is comprised of two hinged halves 17 with means for attaching the hinge halves together so as to permit each half to move 90 degrees from an open position to a closed position. As shown, a center leg pad 18 is disposed substantially in the center of the hinge. The hinge halves 17 are each attached to the center leg pad 18 by means of pins 19 which extend horizontally through each of the hinge halves and the pad. The holes through the hinge halves and pin are dimensioned such that the hinge halves are capable of freely revolving about the pad from a fully opened position shown in FIG. 6 to a closed position shown in FIG. 7. The illustrated hinge hub is a bifold hinge.

Figure 9:
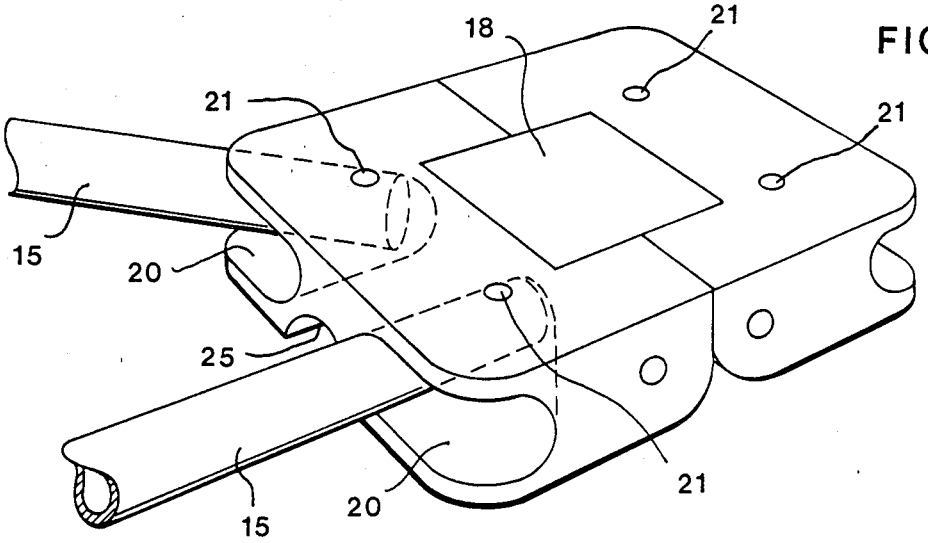
FIG. 9 is a view in perspective of the hinged hub of FIG. 6 showing one floor support bar is an in-use position and a second floor support bar in a position ready for a further folding step.

With reference to FIG. 9, each hinge half is capable of receiving a first end of at least two floor support bars 15. The first end is permanently attached to the hinge so as to allow the floor support bar to laterally swing about in a restricted arculate path. Thus as shown, a receiving slot 20 for receiving the first end of the floor support bar 15 is provided within the interior of the hinge half. A pin 21 extends through the top portion of the hinge half, the floor support bar and the bottom portion of the hinge half so as to hold the bar to the hinge half, yet allow it to move freely in the receiving slot 20.

Figure 10:
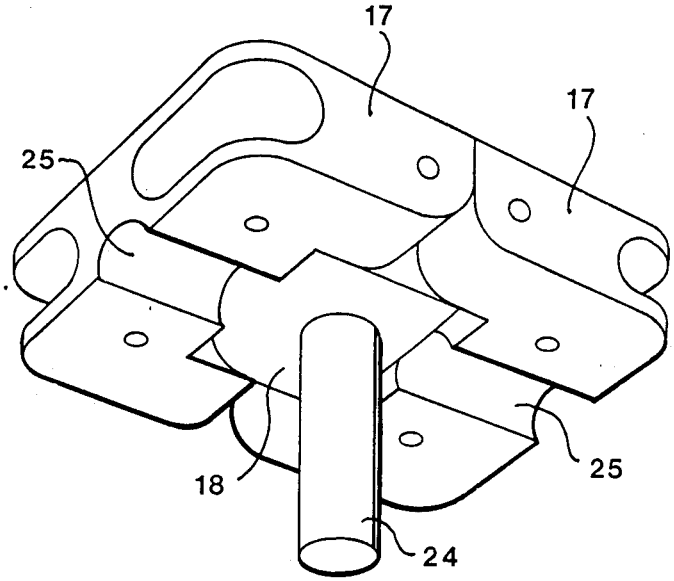
FIG. 10 is a bottom view of the hinged hub of FIG. 6.
Figure 11:
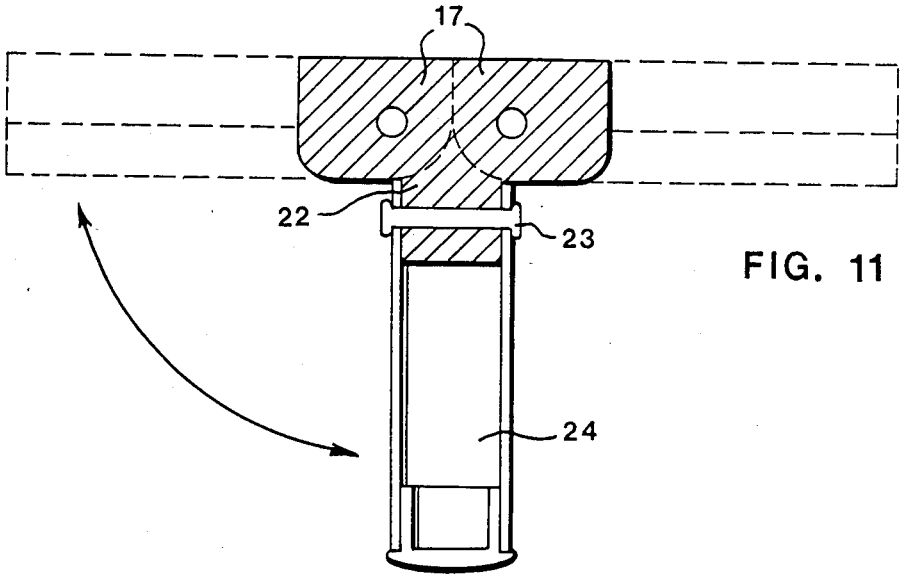
FIG. 11 is a front view of the hinged hub of FIG. 6 in section with a center support leg attached to a center leg pad.

As an optional embodiment of the invention, the center leg pad 18 has a protrusion 22 on its underside so as to permit the attachment by means of pin 23 of a center support leg 24 to the protrusion. The center support leg 24 provides a degree of stability in the center of the playpen. Other center support means as well as other support means attachments can be used for accomplishing this purpose. A groove 25 as best shown in FIGS. 9 and 10, must be provided in the underside of the hinged hub to accommodate any center support leg when the hinge halves are closed. While optional, the center support leg is highly preferred because of the added measure of stability it adds to the playpen assembly when in use.

Frame members 13 are each comprised of a floor support bar 15, a corner support casing 16, an enclosure support bar 14, and latch means 26 for holding the enclosure bar in an upright position. The floor support bar 15 extends from the hinged hub 12 to the corner support casing 16. It is generally tubular in shape, though other shapes as well as solid rods can be used. A bend of approximately 30 to 60 degrees to the vertical is used due to the fact the hinged hub is intended to remain off the floor, while the corner support casing is intended to rest on the floor; consequently, the point of attachment of floor support bar to the hinged hub typically ranges from about 2 to 6 vertical inches from the point of attachment of the floor support bar to the corner support casing. Each end of the floor support bar is received by the hinged hub and corner support casing, respectively and held in permanent position by conventional fastening means, e.g. pins, rivets and bolts/nuts.

Figure 12:
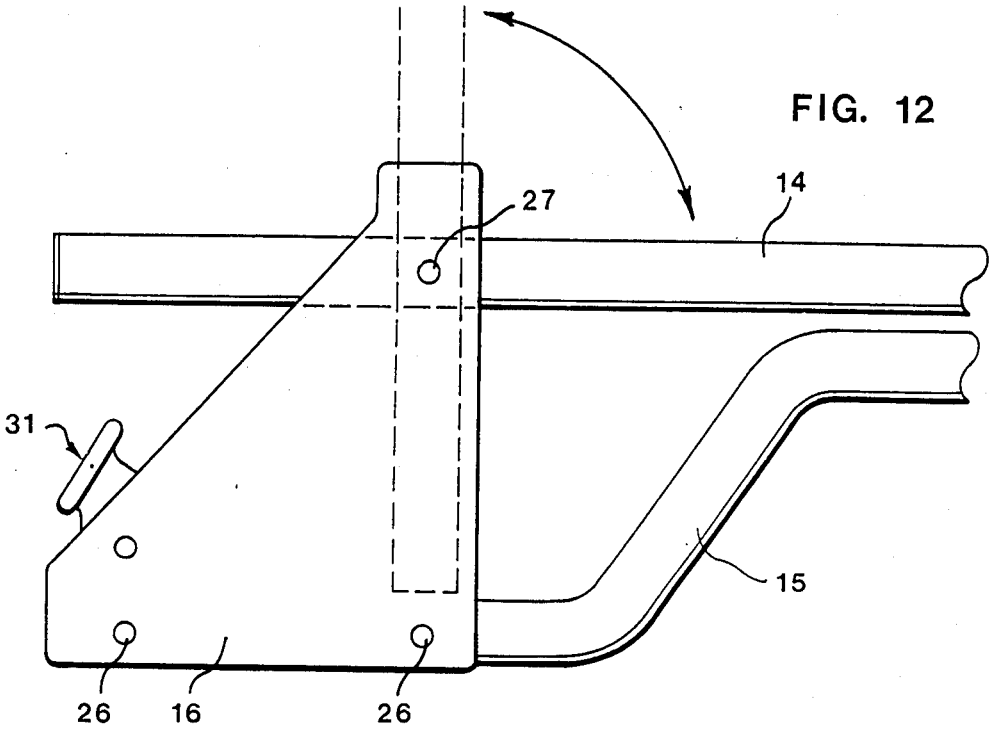
FIG. 12 is a front view of the corner support casing used in the frame assembly of FIG. 2.
Figure 13:
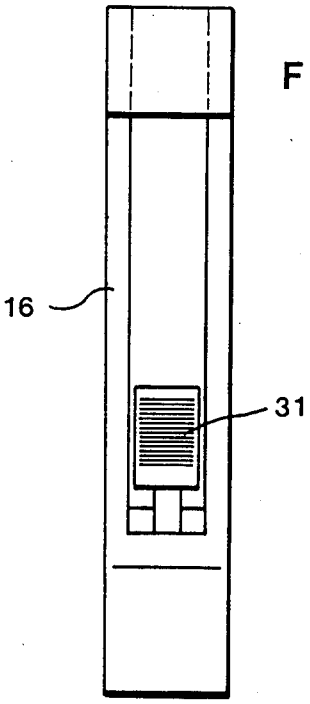
FIG. 13 is an end view of the corner support casing of FIG. 12 taken along lines 13—13 without any support bars.
Figure 14:
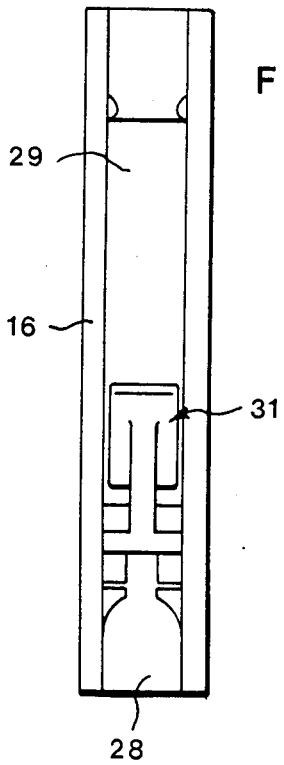
FIG. 14 is a second end view of the corner support casing of FIG. 12 taken along lines 14—14 without any support bars.

The corner support casing 16 of FIGS. 12–14 has means for receving the second end of the floor support bar and one end of enclosure support bar. Attachment means 26 as aforedescribed are used for holding the floor support bar in a fixed position to the corner support casing. The enclosure support bar is attached to the corner support casing so as to permit movement in a restricted arc from a substantially upright in-use position shown in phantom in FIG. 12 to a substantially horizontal fold-up position. A single pin 27 extending through the corner support casing and enclosure support bar is suitable for this purpose. FIGS. 13 and 14 are end views of the corner support casing of FIG. 12. The second end of floor support member extends into a receiving channel 28 and is permanently attached by pins 26. Enclosure support bar 14 extends into receiving channel 29 and is held in position by pin 27. The interior of the corner support casing is open so as to permit the enclosure support bar 14 to swing about pin 27 from a substantially upright position to a substantially horizontal position. The enclosure support bars 14 are dimensioned and attached to the corner support casing so that when folded down one end of the bar extends sufficiently to be substantially even with the opposite side of corner support casing. This permits for a more stable standing when the frame assembly is placed in a fully folded position as shown in FIG. 5.

A stabilizing protrusion 30 (shown in FIG. 15) is optionally provided on an inside surface of corner support casing to stabilize the enclosure support bar when in a fold-up position. As the enclosure support bar swings in its restricted arculate path, a limited amount of force must be applied to cause the bar to move over the protrusion. Once moved to its fold-up position, additional force must be applied to cause the leg to swing upwardly. In effect, the protrusion 30 limits the free movement of enclosure support bar 14.

Figure 15:
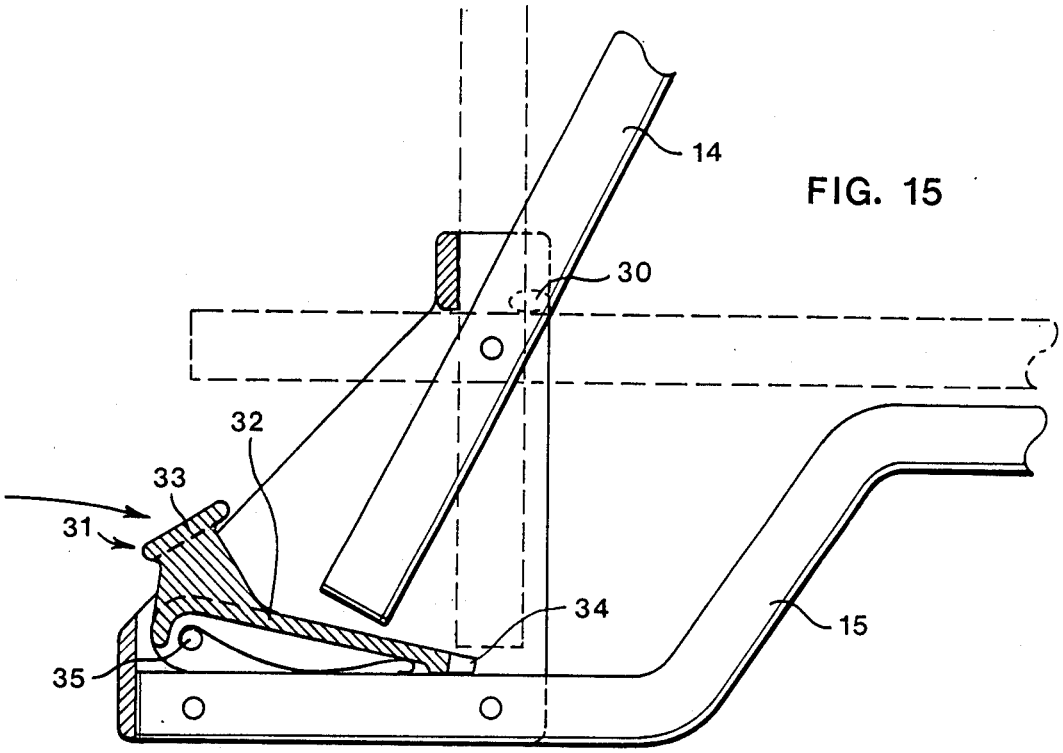
FIG. 15 is a top plan view of the corner support casing of FIG. 10 showing a latch mechanism.
Figure 16:
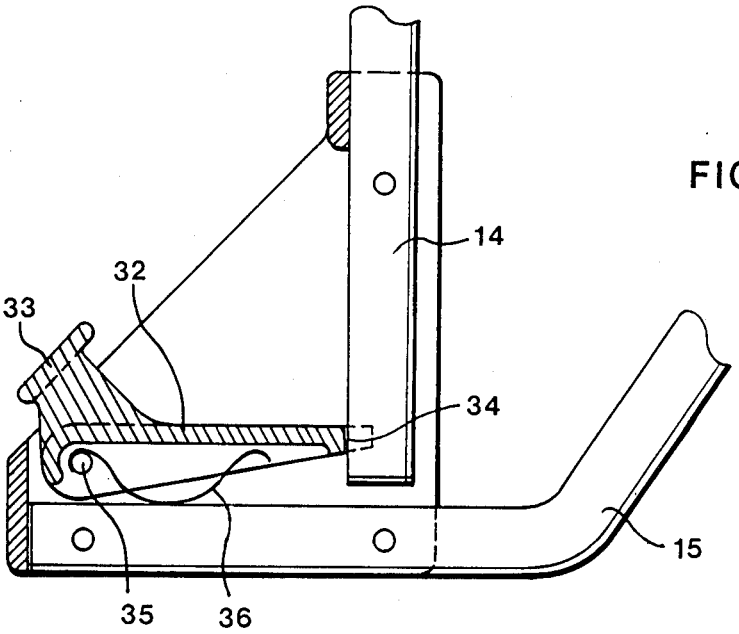
FIG. 16 is top plan view of the corner support casing and latch mechanism of FIG. 15 when the latch is engaged.
Figure 17:
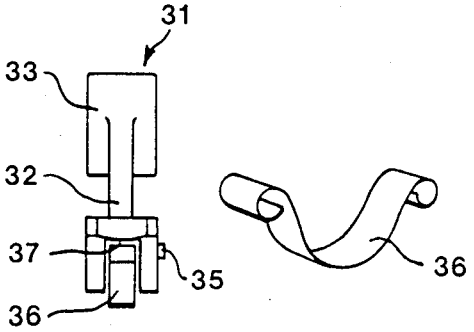
FIG. 17 is an end view of the latch mechanism and spring of FIG. 15.

Any of various latch means are used for holding each enclosure support bar in a substantially upright position during periods of use. FIGS. 15–17 show one preferred latch means especially useful with the corner support casing. The latch means shown generally as 31 comprises an arm 32 having a lever grip 33 on one end, a detent 34 on the other end and a spring mechanism 36. The latch means is positioned within the corner support casing by pin 35 so as to permit the end of enclosure support bar 14 to ride along the upper side of the arm 32 and be locked into place by detent 34. The pin 35 allows arm 32 to move in a restricted path. The enclosure support bar is shown in FIG. 16 locked in a substantially upright position. Applying a downward force to lever grip 33 causes arm 32 to pivot downwardly about pin 35 until detent 34 is low enough that it releases the enclosure support bar 14. Enclosure support bar 14 can now swing about its pin 27 to ride along the arm 32 until stopped by an inside edge of corner support casing 16. Reverse movement of the enclosure support bar causes it to ride along arm 32. The force on the arm compresses the spring 36 downwardly until enclosure suppport bar reaches the detent end of the arm, at which point force from the spring causes arm 32 to move upwardly thereby locking enclosure support bar 14 in position. A trough 37 in the underside of arm 32 as apparent in FIG. 17 is dimensioned to receive the midsection of the spring and pin 35 is used to ensure the spring remains in position during use. In operation, the spring rides in the trough.

As evident from FIGS. 1 and 2, the enclosure support bars when in an upright position are capable of holding a fabric enclosure. The fabric enclosure can be semi-permanent in the sense it can be removed from the frame assembly and separately folded when not in use. Alternatively, it can be fabricated for permanent attachment to the frame assembly while both in the in-use and fold-up positions. Either of such enclosures can have corner pockets which fit over the enclosure support bars. Alternatively, top support rails can extend across the enclosure support bars for added stability and the fabric enclosure can have end pockets which fit over the top support rails and support bars. Any of various fabric enclosures can be designed to accommodate the frame assembly of this invention. Conventional padding and flooring can also be used with the fabric enclosure.

In operation, the assembled playpen first has its fabric enclosure removed and put aside or suitably folded together while still on the frame assembly. Thereafter, each of the latch means are disengaged so as to permit the enclosure support bars to fold to a position which is substantially parallel to the floor support bars. Next, adjacent frame members are moved towards one another. Finally, the hinged hub is lifted at its center point thereby causing the hinge halves to close towards one another which in effect results in the frame members folding to a central location, thereby forming a compact, folded assembly.

While the invention has been described with specific reference to the drawings, other embodiments and modifications are apparent and intended to be within the scope of the invention.

What is claimed is:

1. A portable playpen assembly capable of folding to a compact size, comprising:

(a) a frame assembly having: (i) a horizontally hinged bifold hub having two hinge halves with each hinge half having attached thereto a first end of at least two floor support bars, said support bars being capable of moving about said hub in a restricted arc path and (ii) a set of at least four frame members, each comprised of a corner support casing having attached thereto a second end of the floor support bar, an enclosure support bar wherein the enclosure support bar is attached so as to allow said enclosure support bar to swing from an upright position capable of holding a fabric enclosure to a horizontal position substantially parallel to the floor support bar for folding purposes and latch means to hold the enclosure support bar in the upright position; and (b) a fabric enclosure having means for attachment to the frame assembly.

2. The playpen assembly of claim 1 wherein the horizontally hinged hub further comprises a center leg pad which is disposed substantially in a center of the hinged hub and is attached to each of the hinge halves in a manner to allow the hinge halves to freely swing from an open position to a closed position.

3. The playpen assembly of claim 2 wherein the center leg pad further has a means on its bottom side for receiving a center support leg and the underside of the hinged hub has a groove to accommodate said leg when said hinge is closed.

4. The playpen assembly of claim 2 having four frame members.

5. The playpen assembly of claim 1 wherein an arcuate slot is provided in a side of the hinged hub for receiving one end of the floor support bar and a pin is provided for holding the floor support bar to the hinged hub while allowing the restricted arc path movement.

6. The playpen assembly of claim 5 wherein the second end of the floor support bar is bent at an about 30 to 60 degree vertical angle.

7. The playpen assembly of claim 6 wherein the second end of each floor support bar is held to the corner support casing by a set of pins.

8. The playpen assembly of claim 7 wherein each enclosure support bar is attached to the corner support casing by a single pin which permits restricted movement from the fully upright position to a fold-up position.

9. The playpen assembly of claim 7 wherein the latch means comprises a spring-loaded mechanism.

10. The playpen assembly of claim 9 wherein the latch means comprises an arm positioned within the corner support casing along which the enclosure support bar rides with a spring positioned on an under side of the arm wherein movement of the enclosure support bar along the arm compreses the spring until the enclosure support bar reaches a detent at one end of the arm and the compressed spring returns the arm to its original rest position thereby causing the arm to hold the support leg in an upright and locked position and having a lever grip at an other end of the arm wherein applied pressure causes the enclosure support bar to be disengaged from its upright and locked position to ride back along the arm.

11. The playpen assembly of claim 10 further comprising a stabilizing protrusion positioned within the corner support casing to stabilize the enclosure support bar when the frame assembly is in a folded position.

12. The playpen assembly of claim 1 wherein the fabric enclosure has end pockets which fit over the enclosure support bars of the frame assembly to provide an open-topped enclosure.

* * * * *